United States Patent [19]

Hula et al.

[11] Patent Number: 4,986,291

[45] Date of Patent: Jan. 22, 1991

[54] APPARATUS AND PROCESS FOR THE SURFACE TREATMENT OF STRIPS WITH LIQUIDS

[75] Inventors: Emil Hula, Giesshubel; Johann Deyer, Bruck both of Austria

[73] Assignee: Maschinenfabrik Andritz Actiengesellschaft, Austria

[21] Appl. No.: 243,031

[22] PCT Filed: Feb. 5, 1987

[86] PCT No.: PCT/AT87/00005

§ 371 Date: Jul. 22, 1988

§ 102(e) Date: Jul. 22, 1988

[87] PCT Pub. No.: WO88/05832

PCT Pub. Date: Aug. 11, 1988

[51] Int. Cl.[5] ..... B08B 3/04

[52] U.S. Cl. ..... 134/122 R; 134/200

[58] Field of Search ..... 134/64 R, 122 R, 200; 266/111, 112; 159/7, 45

[56] References Cited

U.S. PATENT DOCUMENTS

| | | | |
|---|---|---|---|
| 1,671,810 | 5/1928 | Caughey | 266/112 |
| 1,998,192 | 4/1935 | Haswell | 266/112 X |
| 2,650,599 | 9/1953 | Campbell | 134/64 R |
| 2,994,328 | 8/1961 | Lewis | 134/64 R X |
| 3,048,503 | 8/1962 | Foote et al. | 134/64 R X |
| 3,346,255 | 10/1967 | Greenwood | 134/64 R |
| 3,738,629 | 6/1973 | Coleman | 134/122 R |
| 3,803,996 | 4/1974 | Marshall | 266/112 X |

FOREIGN PATENT DOCUMENTS

| | | | |
|---|---|---|---|
| 820916 | 4/1981 | U.S.S.R. | 134/122 R |
| 2111084 | 6/1983 | United Kingdom | 134/122 R |

*Primary Examiner*—Frankie L. Stinson

*Attorney, Agent, or Firm*—Ladas & Parry

[57] ABSTRACT

Apparatus for the surface treatment of strips with liquid, in particular for the pickling of rolled metal strip. The apparatus comprises a pickling vessel (3), through which the strip (10) is advanced, closed by a cover (4). Between the strip (10) and the cover (4) a means is provided which if the strip rises upwards, guides the latter back into the direction of movement. This means can be formed of profiles providing a sawtooth-like configuration. Such profiles may be formed by guide means (11) which are chamfered on the side from which the strip enters.

35 Claims, 9 Drawing Sheets

APPARATUS AND PROCESS FOR THE SURFACE TREATMENT OF STRIPS WITH LIQUIDS

Figure 1:
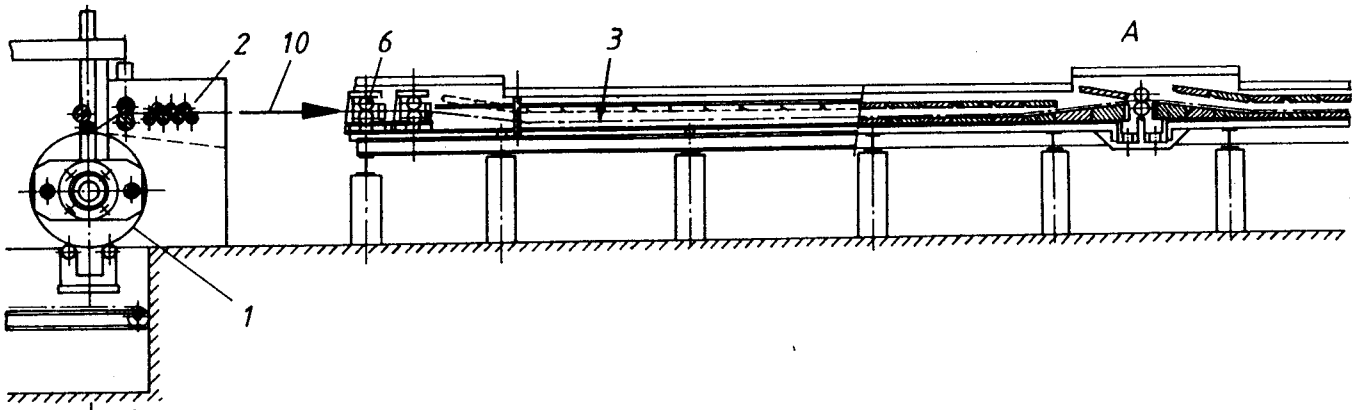

The invention relates to an apparatus for the surface treatment of strips with liquids, in particular for pickling rolled metal strip.

In a large number of strip rolling mills production requirements arise for which the pickling problem, due to the nature and size of the hot strip to be pickled cannot be solved readily. However, frequently the conditions are such that these productions, having regard to their tonnages and the demands made on the surfaces to be pickled on the one hand require the continuous passage of the strip through the pickling plant providing the treatment, what is known as continuous pickling, but as such cannot be applied because of widely varying strip dimensions or poor welding properties.

For such conditions a modern pickling plant known as push-through pickling is now available.

In principle such plant is characterised in that the hot strip, optionally with the simultaneous passage of several strips, is pushed through the plant, whereby the qualitative advantages of a continuous pickle are attained in a simple manner.

The known push-through pickling plants comprise a longitudinal pickling vessel of trough-shaped cross section which is optionally provided with partitions for the simultaneous treatment of several strips, dividing the trough into a plurality of parallel channels and which can be inserted into or lifted from the vessel depending on the desired channel width. The strip is for example pushed through the vessel, flooded with pickling acid, by means of a straightening machine provided at the entry into the pickling vessel. In this context it is known for example to inject the pickling acid from the bottom, whereby the strip is also supplied on its underside with fresh pickling acid and is guided through the pickling vessel. The pickling vessel is conventionally closed by a cover which according to DE-OS No. 30 00 40 can be provided on the bath side with box-shaped inserts dipping into the pickling bath in order to reduce the surface area of the bath, thereby reducing energy consumption, which is caused to a major extent by the evaporation of the pickling acid. In order to protect the immersed cover against damage due to the strip, abrasion protection ribs are provided which on the surface of the inserts facing the bath extend transversely to the direction of movement of the strip.

In operation of the push-through pickling plants it was observed that particularly during the entry of the beginning of the strip, at relatively high travelling rates of the strip, damage may be caused to the cover due to whiplash-like rising upwards. If anti-abrasion strips are fitted extending transversely to the direction of travel of the strip, the front end of the strip may hit these, rip them off and/or itself suffer damage.

It is an object of the invention to provide an expedient to mitigate the last mentioned risk. This object is attained in an apparatus of the type described in the introduction, in which the strip being treated is guided through a trough-shaped vessel, in that according to the invention above the strip a guide means is provided which guides the strip into the desired direction of movement if it rises upwards.

This allows throughput velocities exceeding 200 m/min to be attained.

Such a means may for example be a cover provided with sawtooth-like profiles facing the direction of movement of strip with a chamfer. According to one embodiment such profiles may be formed by a succession of rails, guide beams, plates or the like of wear-resistant material inserted into the pickling vessel and which are chamfered on the side from which the strip enters. These rails, guide beams, plates or the like may, except for the chamfering, have a rectangular cross section and extend transversely to the strip movement, being subdivided or in one piece.

It stands to reason that other constructional solutions, such as, for example, in the form of deflecting devices, may be employed. Thus it is possible to employ instead of the guide beams or the like, successions of rollers which may be freely movable or motor-driven. In the latter case the rollers must be driven in the strip region in the direction of movement of the latter.

In the drawing a working example of the apparatus according to the invention is illustrated. There is shown in FIG. 1 and 1*a* a longitudinal elevation of parts of the apparatus, partly in section, FIGS. 2 and 2*a*, a plan view of the portions of the apparatus according to FIG. 1, FIG. 3, the portion A of the apparatus according to FIG. 1 on a larger scale, FIG. 4, a section along the line IV—IV of FIG. 3, FIG. 5, the portion B of the apparatus on a larger scale, FIG. 6, a section along the line VI—VI of FIG. 5, FIG. 7, a section along the line VII—VII of FIG. 5, FIG. 8, a cross section through the pickling vessel, FIG. 9, a detail of the vessel according to FIG. 8, FIG. 10, a plan view onto the vessel according to FIG. 8, FIG. 11, a plan view onto another region of the pickling vessel, FIG. 12, a section along the line XII—XII of FIG. 11 and FIGS. 13*a* to 13*c*, various embodiments of guide beams used in the apparatus.

The apparatus comprises a feeder spindle 1 which may optionally be adapted for the simultaneous accommodation of a plurality of strip lengths from independent feed drums. From there the strip 10, after prior uncoiling, is advanced to a straightening machine 2. This machine serves not only for straightening the strip but at the same time it provides for the pushing of the strip through the plant up to the first pair 6 of transport rollers and onwards until the beginning of the strip is taken up by the take-up reel 9.

The strip enters into the pickling vessel 3 and there is pushed through shallow pickling dishes which are flooded with pickling acid from a pickle vessel therebelow.

Figure 2:
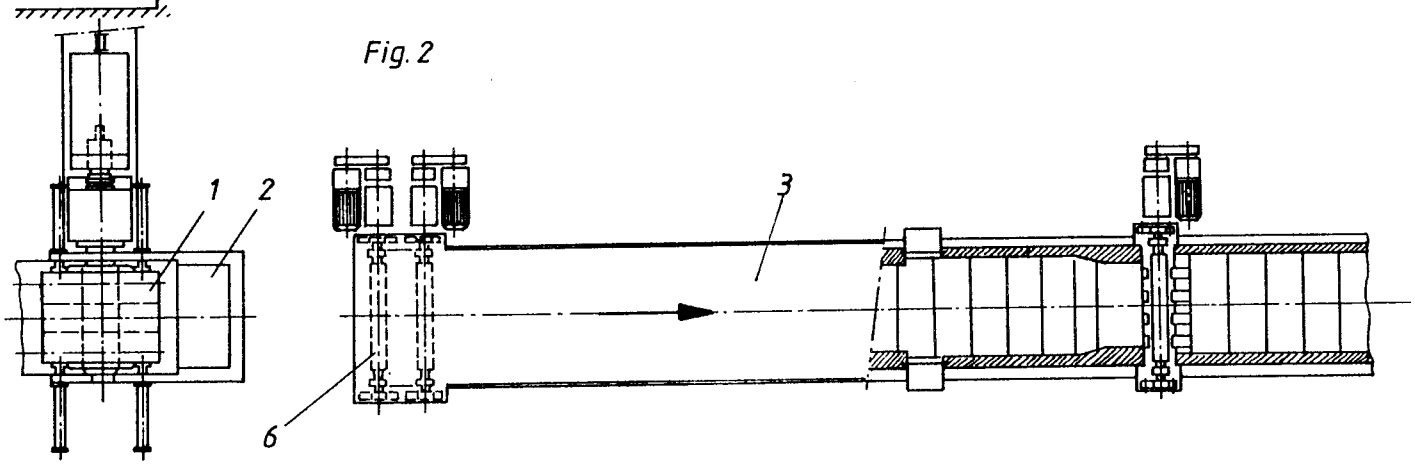
Figure 1A:
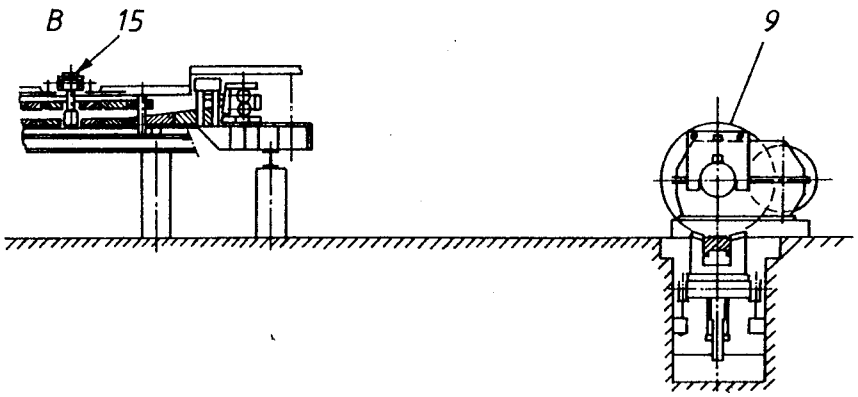
Figure 2A:
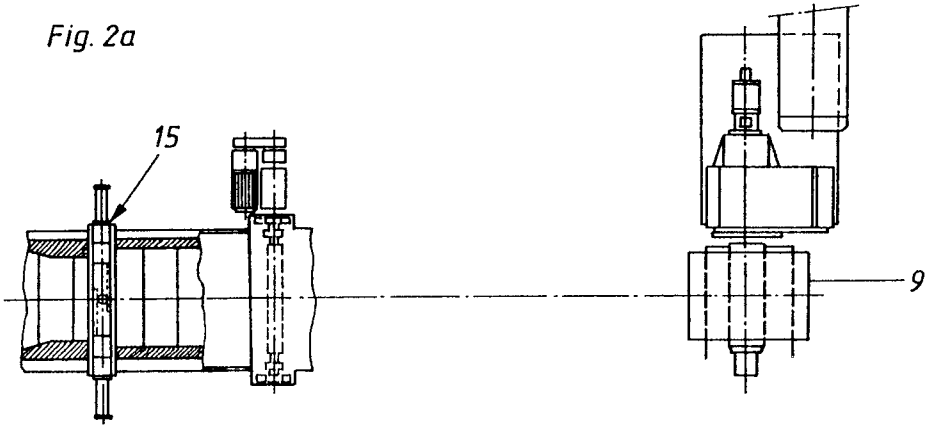

After pickling the strip is rinsed, optionally subjected to further treatment and finally dried and passed by way of traction rolls to the take-up reel 9 (FIG. 1, 2).

Figure 3:
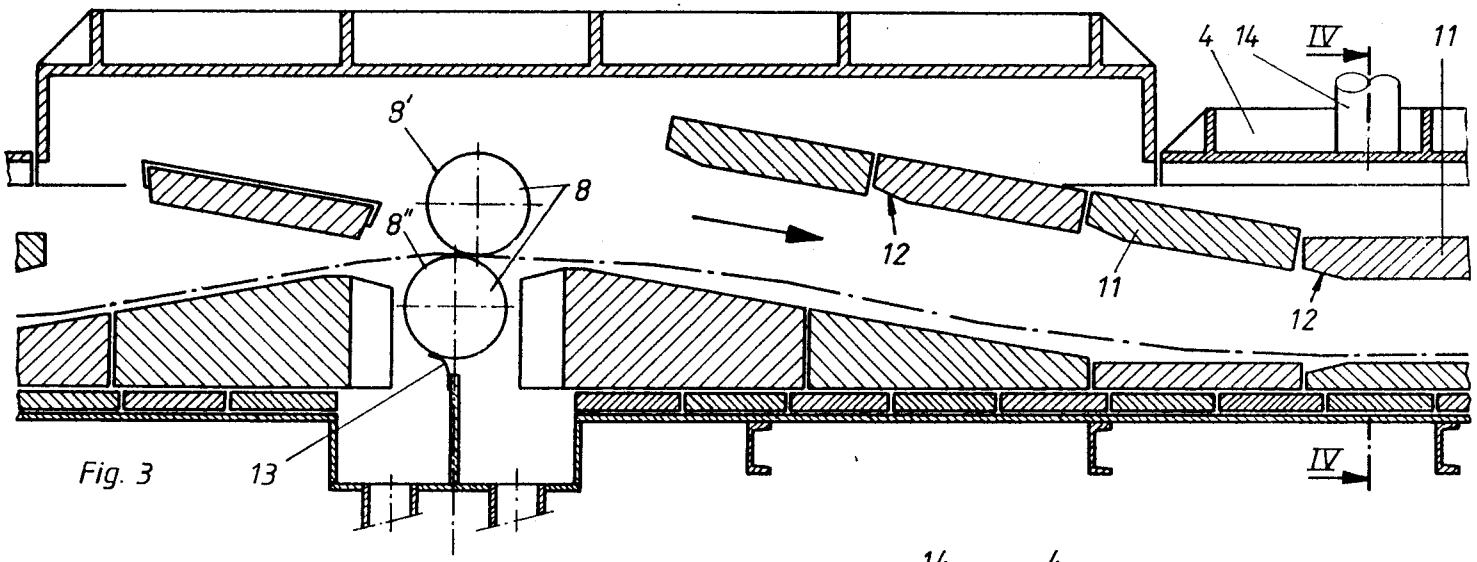

The pickling vessel 3 is closed by a cover 4. For protecting this cover against damage by whiplash of the beginning of the strip or the rising upwards of strip sections, successive guide beams 11 are provided underneath the cover on opposite longitudinal ledges 5 of the side walls 7 which may extend down to the liquor level. In order to prevent the front end of the strip from getting stuck during its introduction in the grooves extending transversely to the direction of strip travel between adjoining guide beams 11 or getting malaligned or preventing the leading edge of the guide beams extending transversely to the direction of travel of the strip being knocked off or damaged during the passage of undulating or poorly rolled strip, the edges 12 of the guide beams 11 facing the advancing strip and extending transversely to the direction of travel of the strip are chamfered whereby the successively aligned guide beams 11 form above the strip 10 a sawtooth-like ceiling having teeth which in the direction of travel of the strip rise at an incline respectively, in the case of the preceding downwardly facing teeth, form obliquely downwardly inclined flanks. If the strip 10 rises upwardly along a longitudinal section thereof or with the advancing front end and meets the guide beam 11, it is deflected downwardly by the latter or by the inclined surfaces 12' (FIG. 3).

Figure 4:
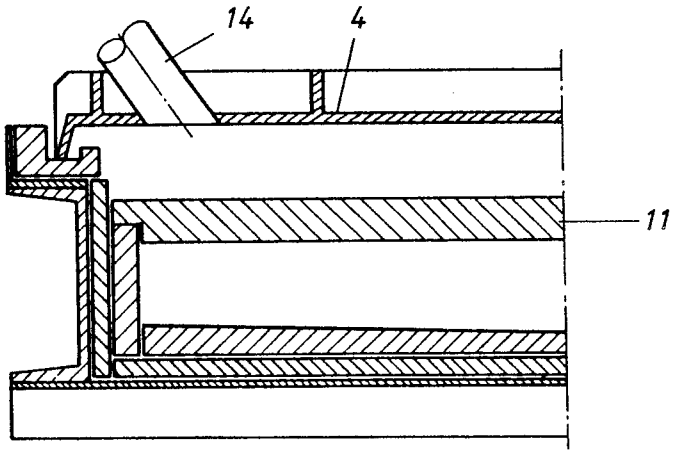

Due to the guiding means and the covers which are independent thereof a double seal of the pickling trough against the atmosphere is provided. A cavity is formed between the deflecting means and the covers independent therefrom in which an air buffer is formed in which the hydrogen gas generated during pickling can escape to a limited extent through the gaps remaining between the deflecting beams. Unavoidably a minor amount of acid vapour enters jointly with this hydrogen gas into the cavity. These gases and vapours which are now diluted by air are sucked off from this cavity through a nipple 14 in the cover 4. Thus the evaporation of acid and the resultant loss of thermal energy is reduced in spite of the pickle bath surface being not impaired (FIG. 4).

As mentioned before in the introduction, alternative means for downwardly deflecting the strip may be provided instead of the illustrated guide beams 11.

A plurality of pickling vessels of the described type may be provided in which case between any two such pickling vessels a transport, respectively squeegy roller pair 8 (FIG. 3) can be provided between which the strip 10 passes and is freed of pickling acid to a major extent. In this context the two rollers 8', 8'' of the squeegy roller pair 8 are provided in mutually staggered relationship such that the upper roller 8' viewed in the direction of advance of the strip 10, succeeds the lower roller 8'' and being provided with a sealing lip 13 for separating the pickling liquors of the individual sections. At least one of the two squeegy rollers may be driven. This separation of the liquors of the individual sections causes the formation of different iron and acid concentrations in such a manner that in the first pickling section the highest iron content prevails and the lowest free acid concentration whilst in the last section the lowest iron and the highest acid concentration prevails. In this manner the pickling time is shortened substantially. At least one of the two squeegy rollers can be driven.

Figure 5:
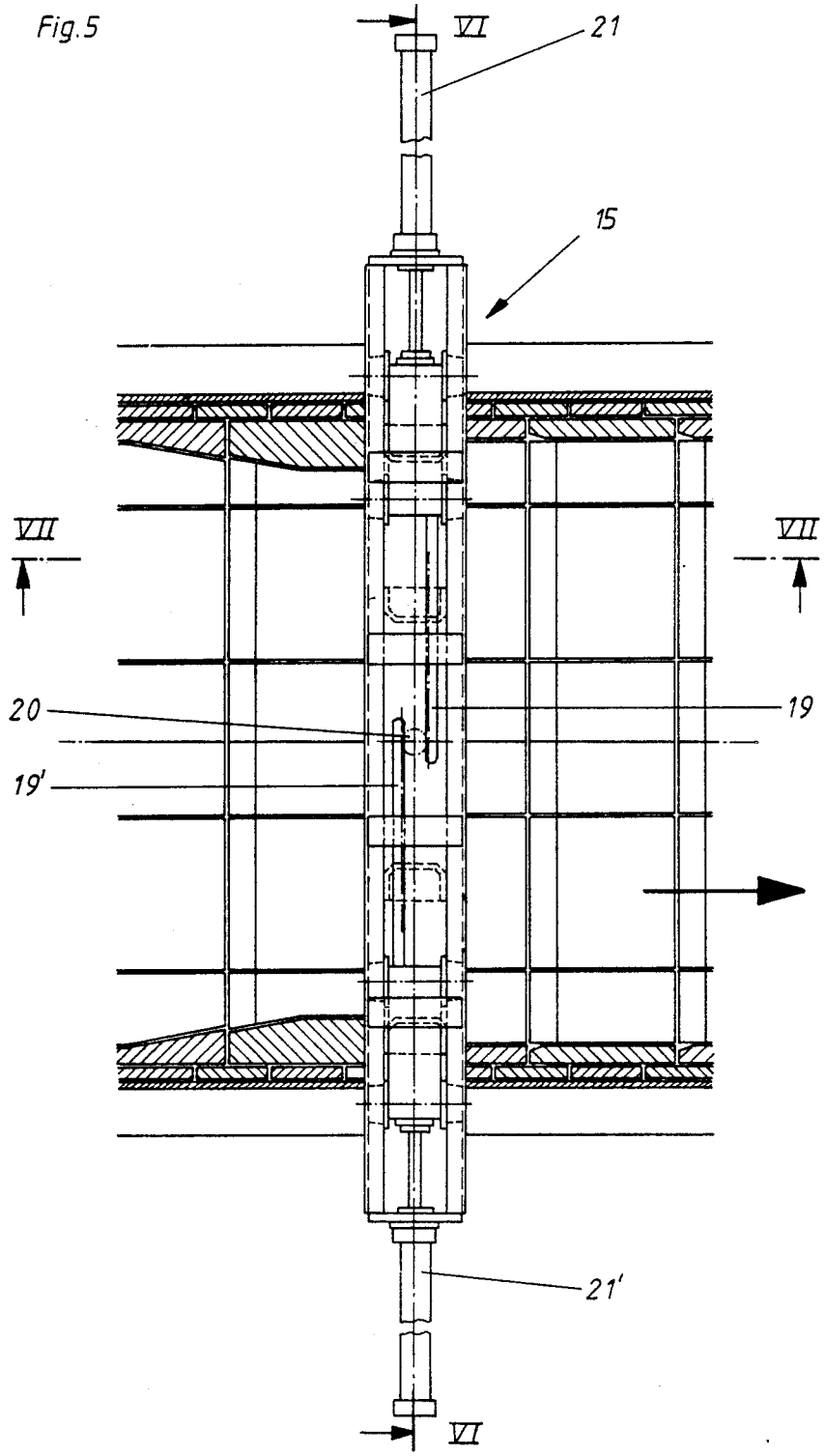
Figure 6:
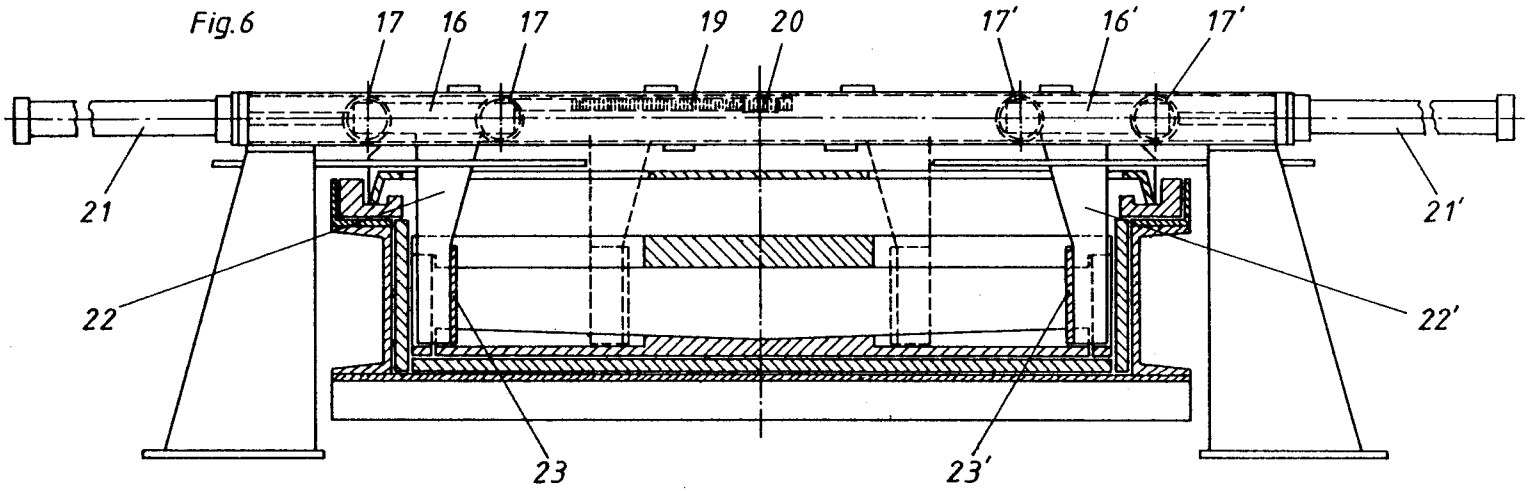
Figure 7:
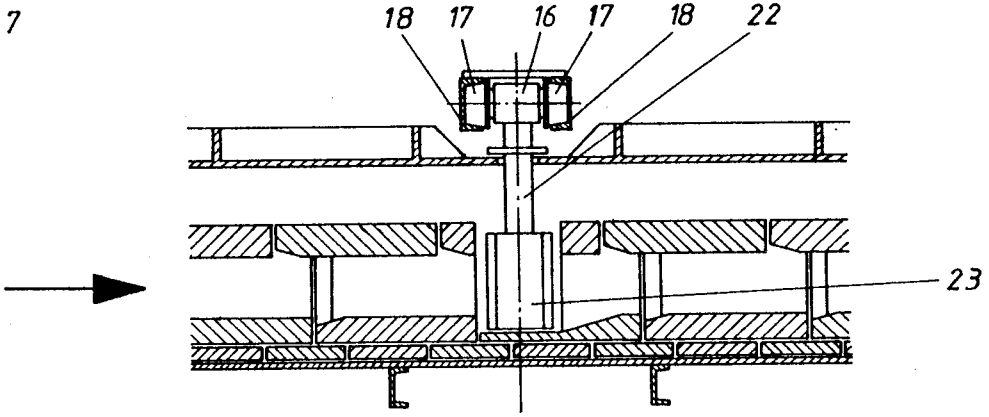

For centering the strip passage in relation to the longitudinal axis of the plant, lateral strip guides (FIGS. 1 and 2) are provided, for example preceding the last pair of squeegy rollers of the pickling vessel, and which are adjustable for the various strip widths. As can be seen in FIGS. 5 and 7, these lateral strip guides comprise two carriages 16, 16' travelling in opposite directions, of which each runs on two pairs of rollers 17 and 17' respectively, guided in guides 18, each carriage carrying a tooth rack 19 or 19' respectively, meshing with a common pinion positioned in the longitudinal axis, whereby a synchronised movement of the two carriages 16, 16' is attained. Each of the two carriages 16 or 16' respectively is connected to a hydraulic cylinder 21 or 21' respectively, moving the carriages 16 and 16' respectively towards one another and apart as the case may be. Regarding the pinion 20, it is also possible for the one cylinder 21 to move the carriages 16, 16' towards one another and the other cylinder 21' to move the carriages apart or vice versa. Each of the two carriages 16, 16' carries on its underside a bracket 22, 22' fitted with a plate 23, 23' of acid resistant material, preferably of ceramic wear-resistant material which is moved towards the front end of the strip for centering the latter. Centering of the strip front end takes place at the instant when the front end of the strip has just passed the centering cheeks but has not yet become clamped between the transport rollers.

Figure 8:
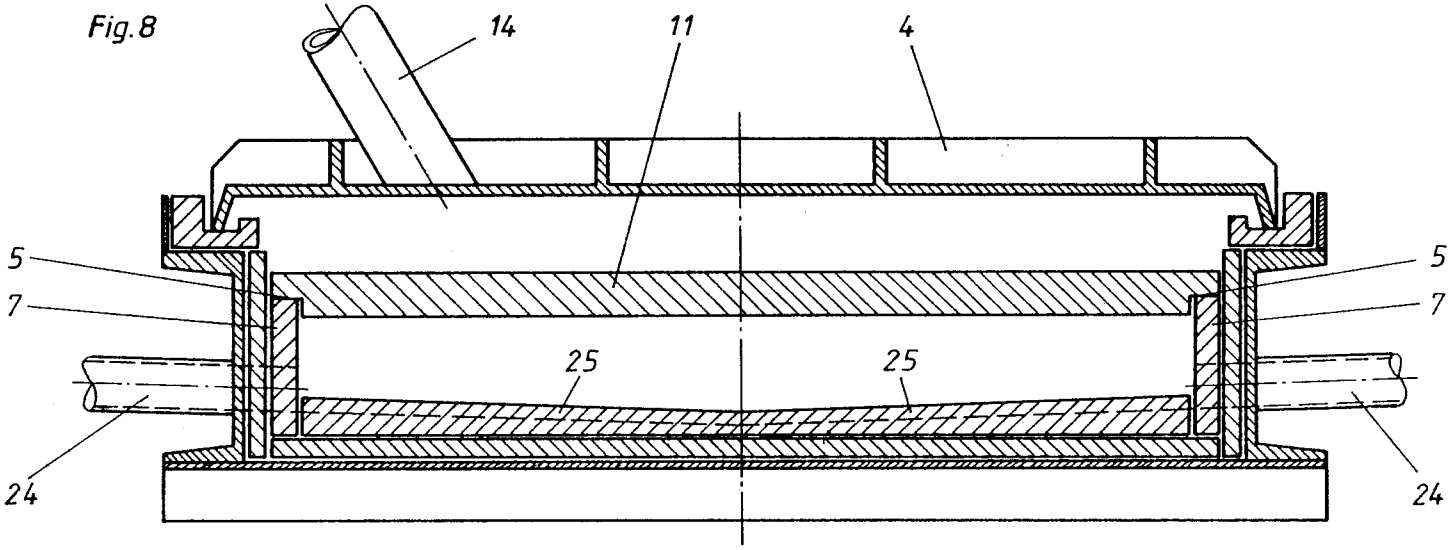
Figure 9:
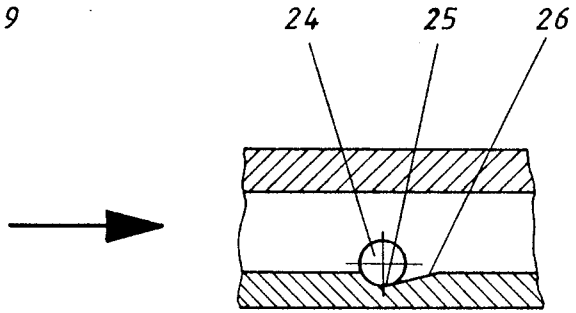
Figure 10:
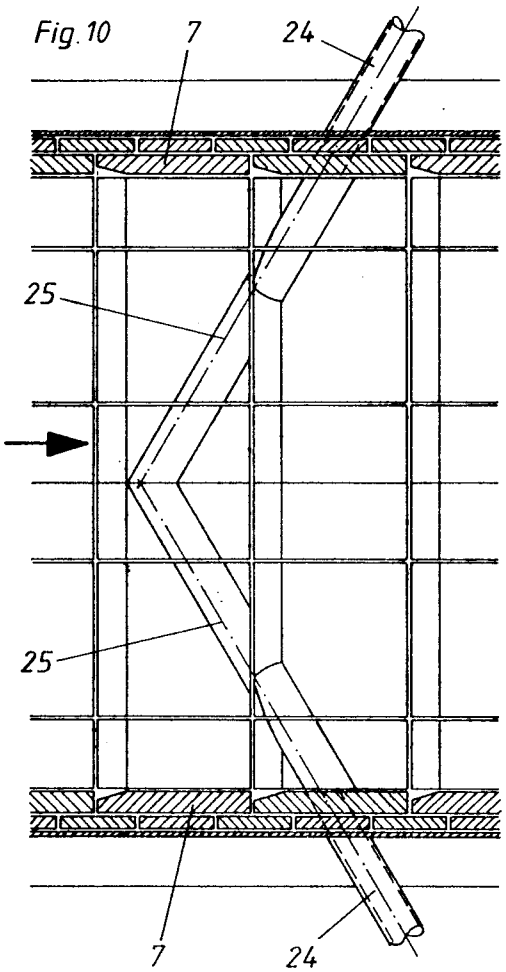

FIG. 8 shows a cross section of the pickling vessel 3, including a preferred embodiment of the bottom which on both sides, starting from the side walls 7, proceeds with a slight downward inclination towards the centre region of the bottom. As will be seen from FIGS. 8 and 10, pipe nipples 24 are provided on the side walls 7 and at intervals along the pickling vessel 3 entering laterally obliquely and serving for feeding the pickling liquor. Hemi-circular depressions 25 are provided in the bottom as continuations of the pipe nipple 24, similarly extending obliquely towards the centre where they meet each other. The longitudinal component of flow of the pickling liquor is thus counterdirected to the direction of travel of the strip. In order to avoid the strip from jamming against the edges of the depressions 25, one edge 26 thereof is rounded off (FIG. 9).

Due to the above described expedients, i.e. slightly inclined configuration of the bottom and arrangement of the depressions with the pipe nipples a flow dynamically favourable guidance of the pickling liquor inside the pickling vessel 3 results. In particular the upwards splashing of the pickling liquor during the absence of strip in the pickling vessel 3 is avoided. The slightly oblique shape of the bottom also results in a certain degree of self-centering of the strip during its movement in longitudinal direction.

Figure 11:
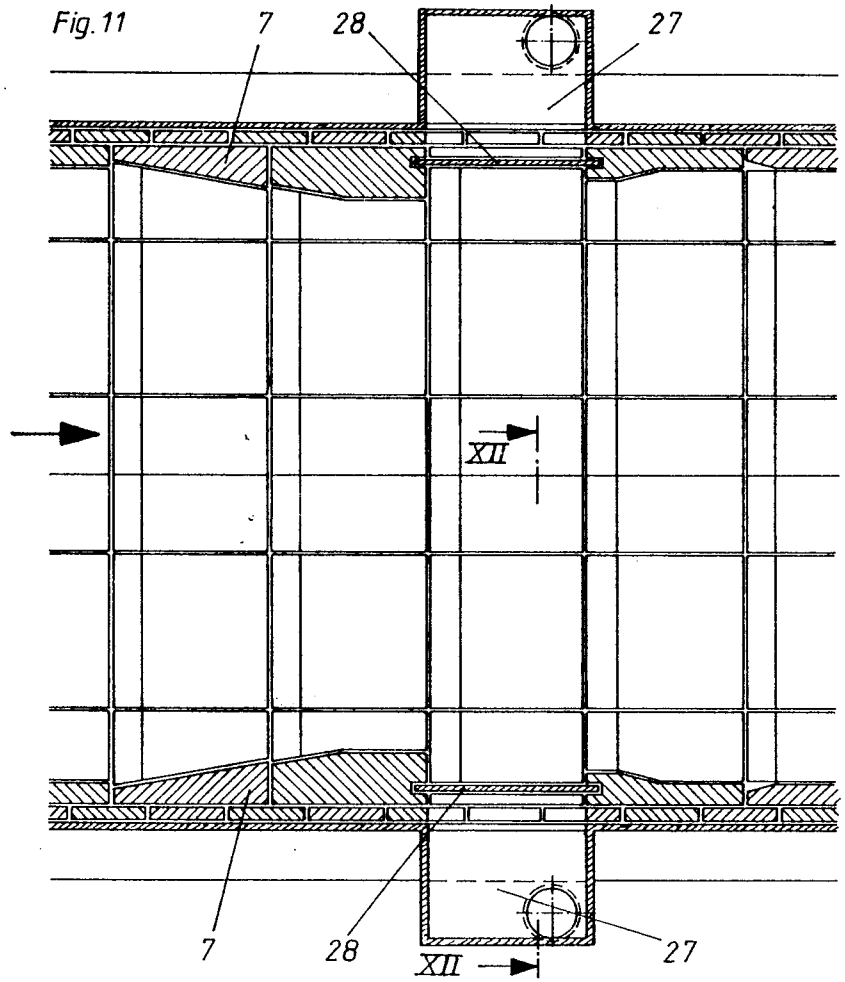
Figure 12:
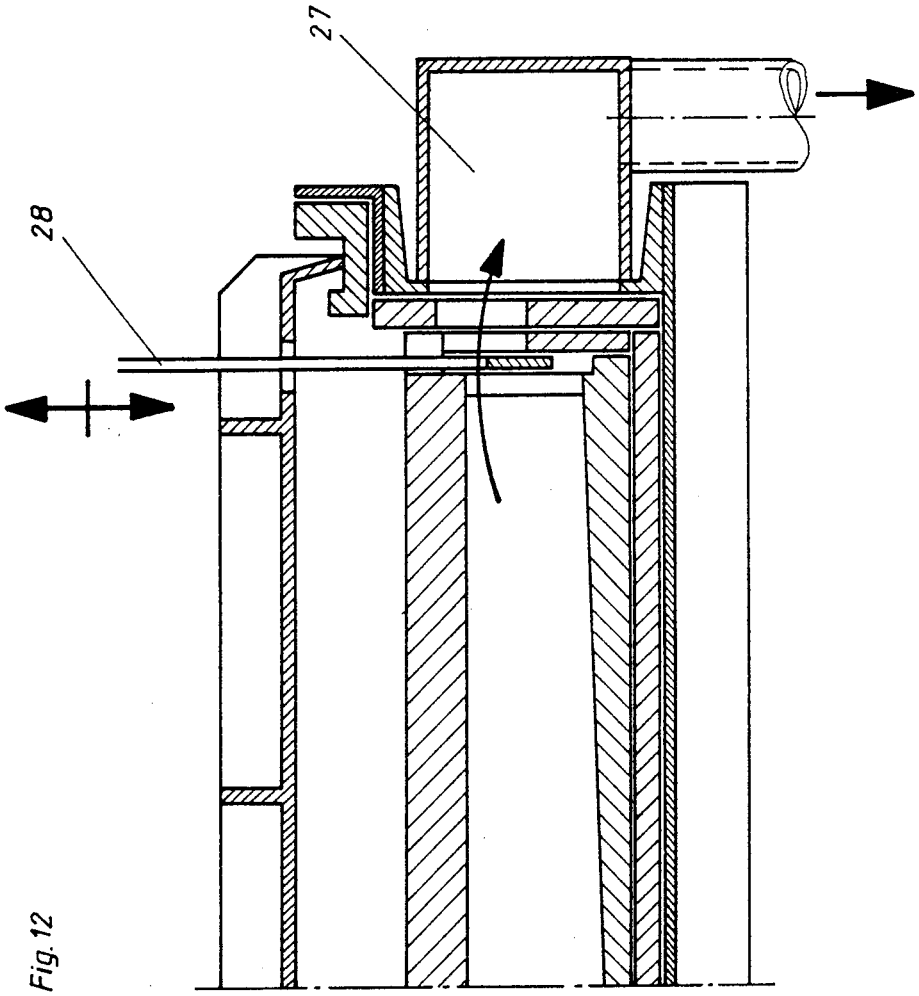

In order to restrict the outflow of pickling liquor to a minimum during the exit of the strip from the pickling vessel 3 to the transport and squeegy rollers, overflow chambers 27 are provided at the side walls 7, preceding the transport and squeegy rollers at a distance, as illustrated in FIG. 11, and which are provided with vertically arranged slider gates for the overflow of the pickling liquor.

The liquor level in the pickling vessel can be adjusted by the level adjustable slider gates 28 or flaps or the like.

Figure 13A:
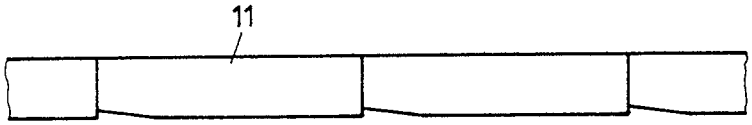
Figure 13B:
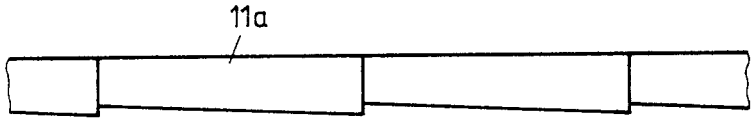
Figure 13C:
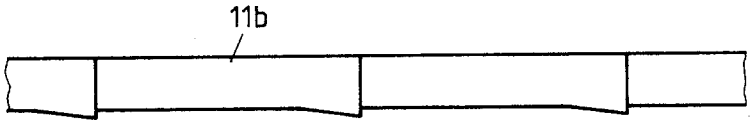
Figure 13D:
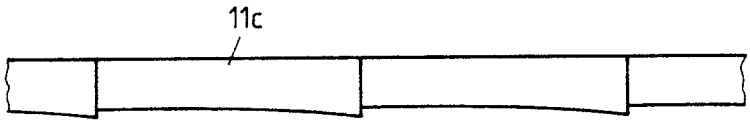
Figure 13E:
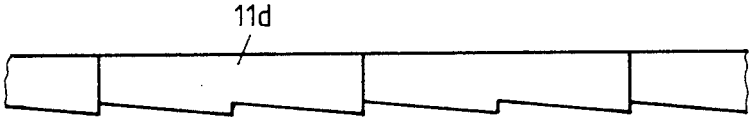

As may be seen from FIGS. **13*a* to 13*e*, a variety of configurations of guide beams can be used. In the guide beam 11, already illustrated in FIG. 3, according to FIG. 13*a*, the chamfer extends on the underside on the entry side of the strip and only over a portion of the width of the guide beam 11. In the guide beam 11*a* according to FIG. 13*b*, the chamfer extends over the entire width of the guide beam 11*a*. In the case of the guide beam 11*b* according to FIG. 13*c*, the chamfer on the exit side of the strip extends over part of the width of the guide beam 11*b*. In the case of the guide beam 11*c* according to FIG. 13*d*, the chamfer extends over the total width of the guide beam 11*c* in the form of a curve, e.g. of circular or exponential arc shapes. Finally, in the case of the guide beam 11*d*** a multiple chamfer, e.g. dual, is provided.

The angle or respectively the maximum angle (in the event of a curved chamfer) amounts to 2° to 10°, preferably 5°.

We claim:

1. Apparatus for pickling a rolled metal strip, said apparatus comprising:

a pickling vessel;

means for covering the vessel;

successive guide-beams located within the vessel above the strip as the strip is guided through the vessel, said guide-beams are formed of wear resistant material, said guide-beams having an underside, formed on said underside and on a side from which the strip enters the vessel are sawtooth-like profiles which are inclined towards a direction of movement of the strip, wherein said guide-beams guide the entering beginning of the strip into the direction of movement when the strip rises upwards.

2. Apparatus according to claim 1 wherein the means serving as a cover is provided with sawtooth-like profiles which in the direction of travel of the strip (10) are inclined towards the latter.

3. Apparatus according to claim 2, wherein the profiles are formed by successive guide beams (11) inserted into the pickling vessel, formed of wear-resistant material and which on the underside and are chamfered over at least a part of the width of the guide beam (11).

4. Apparatus according to claim 3, wherein the guide beams (11) are chamfered on the underside over the entire width of the guide beam (11).

5. Apparatus according to claim 3, wherein the guide beams (11) are chamfered underneath on that side from which the strip leaves over part of the width of the guide beam (11).

6. Apparatus according to claim 3, wherein the guide beams (11) are chamfered underneath over the entire width of the guide beam (11) along a curve.

7. Apparatus according to claim 3, wherein the guide beams (11) chamfered repeatedly on their undersides.

8. Apparatus according to claim 3, wherein the angle, respectively the maximum angle of the chamfering amounts to 2° to 10°, and preferably 5°.

9. Apparatus according to claim 3, wherein the guide beams (11), with the exception of the chamfered regions, have rectangular cross section and extend transversely to the strip movement.

10. Apparatus according to claim 9, wherein the guide beams (11) rest one behind the other on lateral longitudinal shoulders (5) of the side walls (7) of the pickling vessel (3).

11. Apparatus according to claim 3, wherein the guide means (11) are fitted independently of the cover.

12. Apparatus according to claim 1, wherein between the guide means and the cover (4) a cavity is provided into which enters a suctional withdrawal means.

13. Apparatus according to claim 1, wherein for the lateral guidance of the beginning of the strip an adjustable guide (15) is provided.

14. Apparatus according to claim 13, wherein the adjustable lateral guide (15) in the pickling vessel comprises plates (23, 23') of acid resistant material, movable together and apart transversely to the movement of the strip, each being connected to a carriage (16, 16') which is adapted to travel transversely to the direction of movement of the strip.

15. Apparatus according to claim 14, wherein the two carriages are coupled to be driven in conjunction with one another.

16. Apparatus according to claim 15, wherein at least one of the two carriages (16, 16') is connected to a hydraulic or pneumatic cylinder (21, 21').

17. Apparatus according to claim 15, wherein both carriages (16, 16') are each provided with a tooth rack extending transversely to the direction of movement of the strip, the two tooth racks facing each other and meshing with a common pinion (20).

18. Apparatus according to claim 1, wherein the bottom of the pickling vessel (3), starting from the side wall 7, proceeds with a slight downward inclination towards the center of the bottom, the strip guided in its movement by said inclination.

19. Apparatus according to claim 1, wherein spaced apart pipe nipples 24 are provided on the side walls (7) along the length of the pickling vessel (3), entering into the pickling vessel sideways at an incline and serving for feeding the pickling liquor.

20. Apparatus according to claim 19, wherein hemicircular recesses (25) are provided as continuations of the pipe nipples (24) in the bottom of the pickling vessel (3).

21. Apparatus according to claim 20, wherein the recesses (25) extend at an incline down to the centre of the bottom of the pickling vessel (3).

22. Apparatus according to claim 20 wherein at least one edge (26) of the recesses (25) is rounded off.

23. Apparatus according to claim 19, wherein the pipe nipples (24) enter into the pickling vessel (3) sideways at an incline.

24. Apparatus according to claim 1, wherein overflow chambers (27) for the discharge of the pickling liquor are provided on side walls (7) preceding an outlet for the strip from the pickling vessel (3).

25. Apparatus according to claim 24, wherein the overflow chambers (27) are provided at a distance preceding transport and squeegy rollers.

26. Apparatus according to claim 24, wherein the overflow chambers (27) comprise adjustable slider gates (28) or flaps for adjusting the liquor level.

27. Process for operating the apparatus according to claim 1, characterised in that the strip during pickling is flooded with pickling acid up to a level that the latter extends up to the guide means so that parts of the surface of the strip will not emerge from the liquor.

28. Apparatus for for pickling a rolled metal strip in a trough-shaped pickling vessel with cover means, said apparatus comprising:

successive guide-beams located above the strip as the strip travels through the vessel, said guide-beams adapted to guide an entering beginning of the strip into a desired direction of movement when the strip rises upwards, said guide-beams are formed of wear-resistant material and have an underside, on the underside and on the side from which the strip enters are provided, over at least a part of the guide-beam in said direction of movement of the strip, with sawtooth-like profiles which are inclined towards said direction, said guide-beams having rectangular cross-sections extending transversely to said direction; and the vessel having sidewalls, said sidewalls having longitudinal shoulders, said guide beams rest one behind the other on said shoulders.

29. An apparatus as claimed in claim 28 wherein said guide-beams are fitted independently of the cover means.

30. Apparatus for pickling a rolled metal strip, said apparatus comprising:

a pickling vessel, said vessel having sidewalls and a bottom;

guide-beams located above the strip as the strip is guided through the vessel, said guide-beams are formed to guide the entering beginning of the strip into a desired direction of movement when the strip rises upward;

nipples formed on said sidewalls along the length of the vessel serving to provide pickling liquid; and hemi-circular recesses formed as continuations of said nipples on said bottom.

31. An apparatus as claimed in claim 30 wherein said recesses extend at an incline down to a center portion of said bottom.

32. An apparatus as claimed in claim 30 wherein said recesses have at least one edge, at least one of said edge is rounded off.

33. Apparatus for pickling a rolled metal strip, said apparatus comprising:

a pickling vessel;

means for covering the vessel;

successive guide-beams located within the vessel above the strip as the strip is guided through the vessel, said guide beams are formed of wear resistant material, said guide-beams having an underside, formed on said underside and on a side from which the strip enters the vessel are sawtooth-like profiles which are inclined towards a direction of movement of the strip, said guide-beams having a rectangular cross section extending transversely to said direction; and the vessel having sidewalls, said sidewalls having longitudinal shoulders so that said guide beams rest one behind the other on said shoulders.

34. An apparatus as claimed in claim 33 wherein said wear resistant material is ceramic.

35. Apparatus for pickling a rolled metal strip, said apparatus comprising:

a pickling vessel;

means for covering the vessel;

successive guide-beams located within the vessel above the strip as the strip is guided through the vessel, said guide beams are formed of wear resistant material, said guide-beams having an underside, formed on said underside and on a side from which the strip enters the vessel are sawtooth-like profiles which are inclined towards a direction of movement of the strip;

carriages disposed on the vessel to travel transversely to the direction of movement of the strip, said carriages coupled to be driven in conjunction with one another;

plates made of wear resistant material connected to said carriages, the plates and carriages combining to act as adjustable lateral guides as the strip moves through the vessel.

* * * * *